US008994609B2

(12) United States Patent
Gregoire

(10) Patent No.: US 8,994,609 B2
(45) Date of Patent: Mar. 31, 2015

(54) CONFORMAL SURFACE WAVE FEED

(75) Inventor: Daniel J. Gregoire, Thousand Oaks, CA (US)

(73) Assignee: HRL Laboratories, LLC, Malibu, CA (US)

( * ) Notice: Subject to any disclaimer, the term of this patent is extended or adjusted under 35 U.S.C. 154(b) by 199 days.

(21) Appl. No.: 13/242,102

(22) Filed: Sep. 23, 2011

(65) Prior Publication Data

US 2013/0285871 A1 Oct. 31, 2013

(51) Int. Cl.
*H01Q 15/02* (2006.01)
*H01Q 13/20* (2006.01)
*H01Q 13/26* (2006.01)

(52) U.S. Cl.
CPC ..... *H01Q 13/20* (2013.01); *H01Q 13/26* (2013.01)
USPC ..... 343/909; 343/756; 343/700 MS

(58) Field of Classification Search
USPC ..... 343/700 MS, 909, 850, 863, 756
See application file for complete search history.

(56) References Cited

U.S. PATENT DOCUMENTS

| | | | | |
|---|---|---|---|---|
| 3,267,480 | A | 8/1966 | Lerner et al. | |
| 3,560,978 | A | 2/1971 | Himmel et al. | |
| 3,810,183 | A | 5/1974 | Bullai et al. | |
| 3,961,333 | A | 6/1976 | Purinton | |
| 4,045,800 | A | 8/1977 | Tang et al. | |
| 4,051,477 | A | 9/1977 | Murphy et al. | |
| 4,087,822 | A * | 5/1978 | Maybell et al. | 343/778 |
| 4,119,972 | A | 10/1978 | Fletcher et al. | |
| 4,123,759 | A | 10/1978 | Hines et al. | |
| 4,124,852 | A | 11/1978 | Steudel | |
| 4,127,586 | A | 11/1978 | Rody et al. | |
| 4,150,382 | A | 4/1979 | King | |
| 4,173,759 | A | 11/1979 | Bakhru | |
| 4,189,733 | A | 2/1980 | Malm | |
| 4,217,587 | A | 8/1980 | Jacomini | |
| 4,220,954 | A | 9/1980 | Marchand | |
| 4,236,158 | A | 11/1980 | Daniel | |
| 4,242,685 | A | 12/1980 | Sanford | |

(Continued)

FOREIGN PATENT DOCUMENTS

| | | |
|---|---|---|
| DE | 196 00 609 | 4/1997 |
| EP | 0 539 297 | 4/1993 |

(Continued)

OTHER PUBLICATIONS

U.S. Appl. No. 13/243,006, filed Sep. 23, 2011, Gregoire, D., et al.

(Continued)

*Primary Examiner* — Dieu H Duong
(74) *Attorney, Agent, or Firm* — Ladas & Parry

(57) ABSTRACT

A transmission line feed for a surface wave medium having a dielectric substrate with an array of electrically conductive patches formed thereon. The transmission line feed includes a microstrip substrate, the microstrip substrate having a first permittivity which is lower than a second permittivity of the dielectric substrate of the surface wave medium, the microstrip substrate abutting against the dielectric substrate of the surface wave medium; a tapered microstrip disposed on the microstrip substrate, the tapered microstrip tapering from a relatively narrow end to a relatively wide end, the relative wide end terminating where the microstrip substrate abuts against the surface wave substrate; and an adapter for coupling a transmission line to the relatively narrow end of the tapered microstrip.

31 Claims, 3 Drawing Sheets

(56) References Cited

U.S. PATENT DOCUMENTS 4,266,203 A 5/1981 Saudreau et al.
4,308,541 A 12/1981 Frosch et al.
4,367,475 A 1/1983 Schiavone
4,370,659 A 1/1983 Chu et al.
4,387,377 A 6/1983 Kandler
4,395,713 A 7/1983 Nelson et al.
4,443,802 A 4/1984 Mayes
4,590,478 A 5/1986 Powers et al.
4,594,595 A 6/1986 Struckman
4,672,386 A 6/1987 Wood
4,684,953 A 8/1987 Hall
4,700,197 A 10/1987 Milne
4,737,795 A 4/1988 Nagy et al.
4,749,996 A 6/1988 Tresselt
4,760,402 A 7/1988 Mizuno et al.
4,782,346 A 11/1988 Sharma
4,803,494 A 2/1989 Norris et al.
4,821,040 A 4/1989 Johnson et al.
4,835,541 A 5/1989 Johnson et al.
4,843,400 A 6/1989 Tsao et al.
4,843,403 A 6/1989 Lalezari et al.
4,853,704 A 8/1989 Diaz et al.
4,903,033 A 2/1990 Tsao et al.
4,905,014 A 2/1990 Gonzalez et al.
4,916,457 A 4/1990 Foy et al.
4,922,263 A 5/1990 Dubost et al.
4,958,165 A 9/1990 Axford et al.
4,975,712 A 12/1990 Chen
5,021,795 A 6/1991 Masiulis
5,023,623 A 6/1991 Kreinheder et al.
5,070,340 A 12/1991 Diaz
5,081,466 A 1/1992 Bitter, Jr.
5,115,217 A 5/1992 McGrath et al.
5,146,235 A 9/1992 Frese
5,158,611 A 10/1992 Ura et al.
5,208,603 A 5/1993 Yee
5,218,374 A 6/1993 Koert et al.
5,235,343 A 8/1993 Audren et al.
5,268,696 A 12/1993 Buck et al.
5,268,701 A 12/1993 Smith
5,278,562 A 1/1994 Martin et al.
5,287,116 A 2/1994 Iwasaki et al.
5,287,118 A 2/1994 Budd
5,402,134 A 3/1995 Miller et al.
5,406,292 A 4/1995 Schnetzer et al.
5,519,408 A 5/1996 Schnetzer
5,525,954 A 6/1996 Komazaki et al.
5,531,018 A 7/1996 Saia et al.
5,532,709 A 7/1996 Talty
5,534,877 A 7/1996 Sorbello et al.
5,541,614 A 7/1996 Lam et al.
5,557,291 A 9/1996 Chu et al.
5,581,266 A 12/1996 Peng et al.
5,589,845 A 12/1996 Yandrofski et al.
5,598,172 A 1/1997 Chekroun
5,600,325 A 2/1997 Whelan et al.
5,611,940 A 3/1997 Zettler
5,619,365 A 4/1997 Rhoads et al.
5,619,366 A 4/1997 Rhoads et al.
5,621,571 A 4/1997 Bantli et al.
5,638,946 A 6/1997 Zavracky
5,644,319 A 7/1997 Chen et al.
5,694,134 A 12/1997 Barnes
5,709,245 A 1/1998 Miller
5,721,194 A 2/1998 Yandrofski et al.
5,767,807 A 6/1998 Pritchett
5,808,527 A 9/1998 De Los Santos
5,874,915 A 2/1999 Lee et al.
5,892,485 A 4/1999 Glabe et al.
5,894,288 A 4/1999 Lee et al.
5,905,465 A 5/1999 Olson et al.
5,923,303 A 7/1999 Schwengler et al.
5,926,139 A 7/1999 Korisch
5,929,819 A 7/1999 Grinberg
5,943,016 A 8/1999 Snyder, Jr. et al.
5,945,951 A 8/1999 Monte et al.
5,949,382 A 9/1999 Quan
5,966,096 A 10/1999 Brachat
5,966,101 A 10/1999 Haub et al.
6,005,519 A 12/1999 Burns
6,005,521 A 12/1999 Suguro et al.
6,008,770 A 12/1999 Sugawara
6,016,125 A 1/2000 Johansson
6,028,561 A 2/2000 Takei
6,028,692 A 2/2000 Rhoads et al.
6,034,644 A 3/2000 Okabe et al.
6,034,655 A 3/2000 You
6,037,905 A 3/2000 Koscica et al.
6,040,803 A 3/2000 Spall
6,046,655 A 4/2000 Cipolla
6,046,659 A 4/2000 Loo et al.
6,054,659 A 4/2000 Lee et al.
6,055,079 A 4/2000 Hagans et al.
6,061,025 A 5/2000 Jackson et al.
6,075,485 A 6/2000 Lilly et al.
6,081,235 A 6/2000 Romanofsky et al.
6,081,239 A 6/2000 Sabet et al.
6,097,263 A 8/2000 Mueller et al.
6,097,343 A 8/2000 Goetz et al.
6,118,406 A 9/2000 Josypenko
6,118,410 A 9/2000 Nagy
6,127,908 A 10/2000 Bozler et al.
6,150,989 A 11/2000 Aubry
6,154,176 A 11/2000 Fathy et al.
6,166,705 A 12/2000 Mast et al.
6,175,337 B1 1/2001 Jasper, Jr. et al.
6,175,723 B1 1/2001 Rothwell, III
6,188,369 B1 2/2001 Okabe et al.
6,191,724 B1 2/2001 McEwan
6,198,438 B1 3/2001 Herd et al.
6,198,441 B1 3/2001 Okabe et al.
6,204,819 B1 3/2001 Hayes et al.
6,218,912 B1 4/2001 Mayer
6,218,997 B1 4/2001 Lindenmeier et al.
6,246,377 B1 6/2001 Aiello et al.
6,252,473 B1 6/2001 Ando
6,285,325 B1 9/2001 Nalbandian et al.
6,297,579 B1 10/2001 Martin et al.
6,307,519 B1 10/2001 Livingston et al.
6,317,095 B1 11/2001 Teshirogi et al.
6,323,826 B1 11/2001 Sievenpiper et al.
6,331,257 B1 12/2001 Loo et al.
6,337,668 B1 1/2002 Ito et al.
6,366,254 B1 4/2002 Sievenpiper et al.
6,373,349 B2 4/2002 Gilbert
6,380,895 B1 4/2002 Moren et al.
6,388,631 B1 5/2002 Livingston et al.
6,392,610 B1 5/2002 Braun et al.
6,404,390 B2 6/2002 Sheen
6,404,401 B2 6/2002 Gilbert et al.
6,407,719 B1 6/2002 Ohira et al.
6,417,807 B1 7/2002 Hsu et al.
6,424,319 B2 7/2002 Ebling et al.
6,426,722 B1 7/2002 Sievenpiper et al.
6,440,767 B1 8/2002 Loo et al.
6,469,673 B2 10/2002 Kaiponen
6,473,362 B1 10/2002 Gabbay
6,483,480 B1 11/2002 Sievenpiper et al.
6,496,155 B1 12/2002 Sievenpiper et al.
6,515,635 B2 2/2003 Chiang et al.
6,518,931 B1 2/2003 Sievenpiper
6,525,695 B2 2/2003 McKinzie, III
6,538,621 B1 3/2003 Sievenpiper et al.
6,552,696 B1 4/2003 Sievenpiper et al.
6,624,720 B1 9/2003 Allison et al.
6,642,889 B1 11/2003 McGrath
6,657,525 B1 12/2003 Dickens et al.
6,741,207 B1 5/2004 Allison et al.
6,822,622 B2 11/2004 Crawford et al.
6,864,848 B2 3/2005 Sievenpiper
6,897,810 B2 5/2005 Dai et al.
6,940,363 B2 9/2005 Zipper et al.
7,068,234 B2 6/2006 Sievenpiper
7,071,888 B2 7/2006 Sievenpiper

(56) References Cited

U.S. PATENT DOCUMENTS

| | | | |
|---|---|---|---|
| 7,164,387 | B2 | 1/2007 | Sievenpiper |
| 7,173,565 | B2 | 2/2007 | Sievenpiper |
| 7,218,281 | B2 | 5/2007 | Sievenpiper |
| 7,245,269 | B2 | 7/2007 | Sievenpiper et al. |
| 7,253,699 | B2 | 8/2007 | Schaffner et al. |
| 7,253,780 | B2 | 8/2007 | Sievenpiper |
| 7,276,990 | B2 | 10/2007 | Sievenpiper |
| 7,298,228 | B2 | 11/2007 | Sievenpiper |
| 7,307,589 | B1 | 12/2007 | Gregoire et al. |
| 7,782,255 | B2 | 8/2010 | Sego |
| 7,791,251 | B2 | 9/2010 | Kim |
| 7,830,310 | B1 * | 11/2010 | Sievenpiper et al. .. 343/700 MS |
| 7,911,386 | B1 | 3/2011 | Itoh et al. |
| 8,212,739 | B2 | 7/2012 | Sievenpiper |
| 8,436,785 | B1 | 5/2013 | Lai et al. |
| 2001/0035801 | A1 | 11/2001 | Gilbert |
| 2002/0036586 | A1 | 3/2002 | Gothard et al. |
| 2003/0034922 | A1 | 2/2003 | Isaacs et al. |
| 2003/0193446 | A1 | 10/2003 | Chen |
| 2003/0222738 | A1 | 12/2003 | Brown et al. |
| 2003/0227351 | A1 | 12/2003 | Sievenpiper |
| 2004/0113713 | A1 | 6/2004 | Zipper et al. |
| 2004/0135649 | A1 | 7/2004 | Sievenpiper |
| 2004/0227583 | A1 | 11/2004 | Shaffner et al. |
| 2004/0227664 | A1 | 11/2004 | Noujeim |
| 2004/0227667 | A1 | 11/2004 | Sievenpiper |
| 2004/0227668 | A1 | 11/2004 | Sievenpiper |
| 2004/0227678 | A1 | 11/2004 | Sievenpiper |
| 2004/0263408 | A1 | 12/2004 | Sievenpiper et al. |
| 2005/0012667 | A1 | 1/2005 | Noujeim |
| 2006/0192465 | A1 | 8/2006 | Kornbluh et al. |

FOREIGN PATENT DOCUMENTS

| | | |
|---|---|---|
| EP | 1 158 605 | 11/2001 |
| FR | 2 785 476 | 5/2000 |
| GB | 1145208 | 3/1969 |
| GB | 2 281 662 | 3/1995 |
| GB | 2 328 748 | 3/1999 |
| JP | 61-260702 | 11/1986 |
| WO | 94/00891 | 1/1994 |
| WO | 96/29621 | 9/1996 |
| WO | 98/21734 | 5/1998 |
| WO | 99/50929 | 10/1999 |
| WO | 00/44012 | 7/2000 |
| WO | 01/31737 | 5/2001 |
| WO | 01/73891 | 10/2001 |
| WO | 01/73893 | 10/2001 |
| WO | 03/009501 | 1/2003 |
| WO | 03/098732 | 11/2003 |

OTHER PUBLICATIONS

Klopfenstein, R.W., "A transmission line of improved design", *Proceedings of the IRE*, pp. 31-35, Jan. 1956.

I.J. Bahl and D.K. Trivedi, "A designer's guide to microstrip line", *Microwaves*, May 1977, pp. 174-182.

C. Simovskii et al, "High-impedance surfaces having stable resonance with respect to polarization and incidence angel", *IEEE Trans. Antennas Prop.*, vol. 53, 908, 2005.

O. Luukkonen e t al, "Simple and accurate analytical model of planar grids and high-impedance surfaces comprising metal strips or patches", *IEEE Trans. Antennas Prop.*, vol. 56, pp. 1-12, 2008.

D. J. Gregoire and J. S. Colburn, "Artificial impedance surface antenna design and simulation", 2010 Proceedings of the 2010 Antenna Applications Symposium, pp. 288-303.

Fong, B.H.; Colburn, J.S.; Ottusch, J.J.; Visher, J.L.; Sievenpiper, D.F., "Scalar and Tensor Holographic Artificial Impedance Surfaces", *IEEE Trans. Antennas Prop.*, vol. 58, No. 10, pp. 3212-3221, 2010.

Ottusch, J.J.; Kabakian, A.; Visher, J.L.; Fong, B.H.; Colburn, J.S.; and Sievenpiper, D.F.; "Tensor Impedance Surfaces", AFOSR Electromagnetics Meeting, Jan. 6, 2009.

From U.S. Appl. No. 11/324,064 (now U.S. Patent No. 7,307,589), Application and Office Actions including but not limited to the office actions mailed on Apr. 18, 2007 and Aug. 23, 2007.

From U.S. Appl. No. 13/243,006, Application and Office Actions.

From U.S. Appl. No. 13/934,553, Application and Office Actions.

Balanis, C., "Aperture Antennas," Antenna Theory, Analysis and Design, 2nd Edition, Ch. 12, pp. 575-597 (1997).

Balanis, C., "Microstrip Antennas," Antenna Theory, Analysis and Design, 2nd Edition, Ch. 14, pp. 722-736 (1997).

Bialkowski, M.E., et al., "Electronically Steered Antenna System for the Australian Mobilesat," IEEE Proc.-Microw. Antennas Propag., vol. 143, No. 4, pp. 347-352 (Aug. 1996).

Bradley, T.W., et al., "Development of a Voltage-Variable Dielectric (VVD), Electronic Scan Antenna," Radar 97, Publication No. 449, pp. 383-385 (Oct. 1997).

Brown, W.C., "The History of Power Transmission by Radio Waves," IEEE Transactions on Microwave Theory and Techniques, vol. MTT-32, No. 9, pp. 1230-1242 (Sep. 1984).

Bushbeck, M.D., et al., "A tunable switcher dielectric grating", IEEE Microwave and Guided Wave letters, vol. 3, No. 9, pp. 296-298 (Sep. 1993).

Chambers, B., et al., "Tunable Radar Absorbers Using Frequency Selective Surfaces," 11th International Conference on Antennas and Propagation, Conference Publication No. 480, pp. 593-598 (Apr. 17-20, 2001).

Chang, T.K., et al., "Frequency Selective Surfaces on Biased Ferrite Substrates", Electronics Letters, vol. 3o, No. 15, pp. 1193-1194 (Jul. 21, 1994).

Chen, P.W., et al., "Planar Double-Layer Leaky-Wave Microstrip Antenna," IEEE Transactions on Antennas and Propagation, vol. 50, pp. 832-835 (2002).

Chen, Q., et al., "FDTD diakoptic design of a slot-loop antenna excited by a coplanar waveguide," Proceedings of the 25th European Microwave Conference 1995, vol. 2, Conf. 25, pp. 815-819 (Sep. 4, 1995).

Cognard, J., "Alignment of Nematic Liquid Crystals and Their Mixtures," Mol. Cryst. Liq., Cryst. Suppl. 1, pp. 1-74 (1982).

Colburn, J.S., et al. "Adaptive artificial impedance surface conformal antennas," Antennas and Propagation Society International Symposium, 2009. APSURSI '09. IEEE, vol., no., pp. 1-4, Jun. 1-5, 2009.

Doane, J.W., et al., "Field Controlled Light Scattering from Nematic Microdroplets," Appl. Phys. Lett., vol. 48, pp. 269-271 (Jan. 1986).

Ellis, T.J. et al., "MM-Wave Tapered Slot Antennas on Micromachined Photonic Bandgap Dielectrics," 1996 IEEE MTT-S International Microwave Symposium Digest, vol. 2, pp. 1157-1160 (1996).

Fay, P., "High-Performance Antimonide-Based Heterostructure Backward Diodes for Millimeter-Wave Detection," IEEE Electron Device Letters, vol. 23, No. 10, pp. 585-587 (Oct. 2002).

Gianvittorio, J.P., et al., "Reconfigurable MEMS-enabled Frequency Selective surfaces", Electronic Letters, vol. 38, No. 25, pp. 16527-1628 (Dec. 5, 2002).

Gold, S.H., et al., "Review of High-Power Microwave Source Research," Rev. Sci. Instrum., vol. 68, No. 11, pp. 3945-3974 (Nov. 1997).

Grbic, A., et al., "Experimental Verification of Backward-Wave Radiation From a Negative Refractive Index Metamaterial," Journal of Applied Physics, vol. 92, No. 10, pp. 5930-5935 (Nov. 15, 2002).

Gregoire, D. and Colburn, J. S., "Artificial impedance surface antenna design and simulation", 2010 Proceedings of the 2010 Antenna Applications Symposium, pp. 288-303.

Hu, C.N., et al., "Analysis and Design of Large Leaky-Mode Array Employing The Coupled-Mode Approach," IEEE Transactions on Microwave Theory and Techniques, vol. 49, No. 4, pp. 629-636 (Apr. 2001).

Jablonski, W., et al., "Microwave Schottky Diode With Beam-Lead Contacts," 13th Conference on Microwaves, Radar and Wireless Communications, MIKON-2000, vol. 2, pp. 678-681 (2000).

Jensen, M.A., et al., "EM Interaction of Handset Antennas and a Human in Personal Communications," Proceedings of the IEEE, vol. 83, No. 1, pp. 7-17 (Jan. 1995).

(56) References Cited

OTHER PUBLICATIONS

Jensen, M.A., et al., "Performance Analysis of Antennas for Hand-Held Transceivers Using FDTD," IEEE Transactions on Antennas and Propagation, vol. 42, No. 8, pp. 1106-1113 (Aug. 1994).
Koert, P., et al., "Millimeter Wave Technology for Space Power Beaming," IEEE Transactions on Microwave Theory and Techniques, vol. 40, No. 6, pp. 1251-1258 (Jun. 1992).
Lee, J.W., et al., "TM-Wave Reduction from Grooves in a Dielectric-Covered Ground Plane," IEEE Transactions on Antennas and Propagation, vol. 49, No. 1, pp. 104-105 (Jan. 2001).
Lezec, H.J., et al., "Beaming Light from a Subwavelength Aperture," Science, vol. 297, pp. 820-822 (Aug. 2, 2002).
Lima, A.C., et al., "Tunable Freqency Selective Surfaces Using Liquid Substrates", Electronic Letters, vol. 30, No. 4, pp. 281-282 (Feb. 17, 1994).
Linardou, I., et al., "Twin Vivaldi Antenna Fed by Coplanar Waveguide," Electronics Letters, vol. 33, No. 22, pp. 1835-1837 (1997).
Malherbe, A., et al., "The Compensation of Step Discontinues in TEM-Mode Transmission Lines," IEEE Transactions on Microwave Theory and Techniques, vol. MTT-26, No. 11, pp. 883-885 (Nov. 1978).
Maruhashi, K., et al., "Design and Performance of a Ka-Band Monolithic Phase Shifter Utilizing Nonresonant FET Switches," IEEE Transactions on Microwave Theory and Techniques, vol. 48, No. 8, pp. 1313-1317 (Aug. 2000).
McSpadden, J.O., et al., "Design and Experiments of a High-Conversion-Efficiency 5.8-GHz Rectenna,".IEEE Transactions on Microwave Theory and Techniques, vol. 46, No. 12, pp. 2053-2060 (Dec. 1998).
Oak, A.C., et al., "A Varactor Tuned 16 Element MESFET grid Oscillator", Antennas an Propagation Society International Symposium, pp. 1296-1299 (1995).
Patel, A.M.; Grbic, A., "A Printed Leaky-Wave Antenna Based on a Sinusoidally-Modulated Reactance Surface," Antennas and Propagation, IEEE Transactions on , vol. 59, No. 6, pp. 2087,2096, Jun. 2011.
Perini, P., et al., "Angle and Space Diversity Comparisons in Different Mobile Radio Environments," IEEE Transactions on Antennas and Propagation, vol. 46, No. 6, pp. 764-775 (Jun. 1998).
Ramo, S., et al., Fields and Waves in Communication Electronics, 3rd Edition, Sections 9.8-9.11, pp. 476-487 (1994).
Rebeiz, G.M., et al., "RF MEMS Switches and Switch Circuits," IEEE Microwave Magazine, pp. 59-71 (Dec. 2001).
Schaffner, J., et al., "Reconfigurable Aperture Antennas Using RF MEMS Switches for Multi-Octave Tunability and Beam Steering," IEEE Antennas and Propagation Society International Symposium, 2000 Digest, vol. 1 of 4, pp. 321-324 (Jul. 16, 2000.
Schulman, J.N., et al., "Sb-Heterostructure Interband Backward Diodes," IEEE Electron Device Letters, vol. 21, No. 7, pp. 353-355 (Jul. 2000).
Semouchkina, E., et al., "Numerical Modeling and Experimental Study of A Novel Leaky Wave Antenna," Antennas and Propagation Society, IEEE International Symposium, vol. 4, pp. 234-237 (2001).
Sieveniper, D.F., et al., "Two-Dimensional Beam Steering Using an Electrically Tunable Impedance Surface," IEEE Transactions on Antennas and Propagation, vol. 51, No. 10, pp. 2713-2722 (Oct. 2003).
Sievenpiper, D. et al, "Holographic Artificial Impedance Surfaces for conformal antennas", 29th Antennas Applications Symposium, 2005.
Sievenpiper, D., et al. "A steerable leaky-wave antenna using a tunable impedance ground plane," Antennas and Wireless Propagation Letters, IEEE, vol. 1, No. 1, pp. 179-182, 2002.
Sievenpiper, D., et al., "Beam Steering Microwave Reflector Based on Electrically Tunable Impedance Surface," Electronics Letters, vol. 38, No. 21, pp. 1237-1238 (Oct. 1, 2002).
Sievenpiper, D., et al., "Eliminating Surface Currents With Metallodielectric Photonic Crystals," 1998 MTT-S International Microwave Symposium Digest, vol. 2, pp. 663-666 (Jun. 7, 1998).
Sievenpiper, D., et al., "High-Impedance Electromagnetic Surfaces with a Forbidden Frequency Band," IEEE Transactions, on Microwave Theory and Techniques, vol. 47, No. 11, pp. 2059-2074 (Nov. 1999).
Sievenpiper, D., et al., "High-Impedance Electromagnetic Surfaces," Ph.D. Dissertation, Dept. Of Electrical Engineering, University of California, Los Angeles, CA, pp. i-xi, 1-150 (1999).
Sievenpiper, D., et al., "Low-Profile, Four-Sector Diversity Antenna on High-Impedance Ground Plane," Electronics Letters, vol. 36, No. 16, pp. 1343-1345 (Aug. 3, 2000).
Sievenpiper, D., et al., 2005 "Holographic Artificial Impedance Surfaces for Conformal Antennas" IEEE Antennas and Prop. Symp. Digest, vol. 1B, pp. 256-259, 2005.
Sor, J., et al., "A Reconfigurable Leaky-Wave/Patch Microstrip Aperture for Phased-Array Applications," IEEE Transactions on Microwave Theory and Techniques, vol. 50, No. 8, pp. 1877-1884 (Aug. 2002).
Strasser, B., et al., "5.8-GHz Circularly Polarized Rectifying Antenna for Wireless Microwave Power Transmission," IEEE Transactions on Microwave Theory and Techniques, vol. 50, No. 8, pp. 1870-1876 (Aug. 2002).
Swartz, N., "Ready for CDMA 2000 1xEV-Do?," Wireless Review, 2 pages total (Oct. 29, 2001).
Vaughan, Mark J., et al., "InP-Based 28 Gh.sub.2 Integrated Antennas for Point-to-Multipoint Distribution," Proceedings of the IEEE/Cornell Conference on Advanced Concepts in High Speed Semiconductor Devices and Circuits, pp. 75-84 (1995).
Vaughan, R., "Spaced Directive Antennas for Mobile Communications by the Fourier Transform Method," IEEE Transactions on Antennas and Propagation, vol. 48, No. 7, pp. 1025-1032 (Jul. 2000).
Wang, C.J., et al., "Two-Dimensional Scanning Leaky-Wave Antenna by Utilizing the Phased Array," IEEE Microwave and Wireless Components Letters, vol. 12, No. 8, pp. 311-313, (Aug. 2002).
Wu, S.T., et al., "High Birefringence and Wide Nematic Range Bis-Tolane Liquid Crystals," Appl. Phys. Lett., vol. 74, No. 5, pp. 344-346 (Jan. 18, 1999).
Yang, F.R., et al., "A Uniplanar Compact Photonic-Bandgap (UC-PBG) Structure and Its Applications for Microwave Circuits," IEEE Transactions on Microwave Theory and Techniques, vol. 47, No. 8, pp. 1509-1514 (Aug. 1999).
Yang, Hung-Yu David, et al., "Theory of Line-Source Radiation From A Metal-Strip Grating Dielectric-Slab Structure," IEEE Transactions on Antennas and Propagation, vol. 48, No. 4, pp. 556-564 (2000).
Yashchyshyn, Y., et al., The Leaky-Wave Antenna With Ferroelectric Substrate, 14th International Conference on Microwaves, Radar and Wireless Communications, MIKON-2002, vol. 2, pp. 218-221 (2002).
PCT International Search Report and Written Opinion (ISR and WO) mailed on Apr. 3, 2014 from related PCT Application No. PCT/US2013/050412.
Noujeim, Karam M. Fixed-frequency beam-steerable leaky-wave antennas. Ph. D. Thesis. Department of Electrical and Computer Engineering University of Toronto. National Library of Canada, 1998. (163 pages).
Sazegar, M. et al., Beam Steering Transmitarrav Using Tunable Frequency Selective Surface With Integrated Ferroelectric Varactors, IEEE Transactions on Antennas and Propagation, Aug. 13, 2012. vol. 60, No. 12, pp. 5690-5699, ISSN 0018-926X.
From U.S. Appl. No. 13/243,006, (unpublished, non publication requested), Office Action mailed on Apr. 22, 2014.
From U.S. Appl. No. 12/939,040 (now U.S. Patent No. 7,307,589), Application and Office Actions including but not limited to the office action mailed on Apr. 18, 2007 and Aug. 23, 2007.
From U.S. Appl. No. 12/939,040 (now U.S. Patent No. 8,436,785), Application and Office Actions including but not limited to the office action mailed on Jan. 10, 2013.

* cited by examiner

50 Ω launch
15
16
2b
11
Substrate 14 with permittivity $e_1$
Microstrip taper region
13
12
A
Direction of decreasing patch size
Surface wave impedance taper
24
Substrate 22 with permittivity $e_2$
where $e_2 > e_1$
AIS antenna
26
20
2b 16
13
14
26
26
22

CONFORMAL SURFACE WAVE FEED

STATEMENT REGARDING FEDERALLY SPONSORED RESEARCH OR DEVELOPMENT

This invention was made under U.S. Government Contract No. HR0011-10-C-0163 and therefor the U.S. Government may have certain rights in this invention.

CROSS REFERENCE TO RELATED APPLICATIONS

U.S. patent application Ser. No. 13/243,006, filed on the same date as this application and entitled "Conformal Antennas for Mitigation of Structural Blockage" is hereby incorporated herein by reference.

U.S. Pat. No. 7,307,589 to Daniel Gregoire et al. entitled "Large-Scale Adaptive Surface Sensor Arrays"

TECHNICAL FIELD

A conformal surface wave feed provides a transition from a coaxial line or other transmission line to surface wave transmission that can be used to launch a surface wave onto surface-wave media.

BACKGROUND

A Conformal Surface Wave Feed (CSWF) is believed to be unknown in the art. The closest prior art may be a low-profile waveguide (LPWG) surface-wave coupler (see FIG. 1*b*) that has been used to feed previous conformal Artificial Impedance Surface (AIS) antennas.

Disadvantages of this prior art are believed to be that: (1) It is not conformal. As seen in the FIG. 1*b* below, the LPWG protrudes from the antenna surface. (2) Its insertion loss is much higher than the presently described conformal surface wave feed. (3) It radiates power away from the surface into free space. (4) Its bandwidth is lower than the presently described conformal surface wave feed.

BRIEF DESCRIPTION OF THE INVENTION

The present invention relates to CSWF that can be used to feed an AIS antenna or in other applications. The CSWF provides a transition from a coaxial line or other transmission line to surface wave transmission that can be used to launch a surface wave onto surface-wave media of an AIS antenna, for example.

In the CSWF, a wave is launched from a transmission line (typically a 50Ω coax-to-microstrip adaptor) into a tapered microstrip (MS) line that spreads the wave energy out into a broad phase front, and then into a surface-wave medium (SWM). The MS is tapered such that the insertion loss is preferably minimized from one end of the taper to the other. The permittivity of the MS substrate is lower than the permittivity of the SWM substrate in order to match the wave speeds between the MS and the surface wave, thus minimizing insertion loss from the MS to the SWM.

In one aspect the present invention provides a transmission line feed for a surface wave medium having a dielectric substrate with an array of electrically conductive patches formed thereon. The transmission line feed includes: (a) a microstrip substrate, the microstrip substrate having a first permittivity which is lower than a second permittivity of the dielectric substrate of the surface wave medium, the microstrip substrate abutting against the dielectric substrate of the surface wave medium; (b) a tapered microstrip disposed on the microstrip substrate, the tapered microstrip tapering from a relatively narrow end to a relatively wide end, the relative wide end terminating where the microstrip substrate abuts against the surface wave substrate; and (c) an adapter for coupling a transmission line to the relatively narrow end of the tapered microstrip.

In another aspect the present invention provides a method of feeding RF energy to a surface wave medium having a dielectric substrate with an array of electrically conductive patches formed thereon, the RF energy being fed to said surface via a coaxial transmission line feed. The method includes: providing a microstrip substrate having a first permittivity which is lower than a second permittivity of the dielectric substrate of the surface wave medium; butting the microstrip substrate against the dielectric substrate of the surface wave medium; forming a tapered microstrip on the microstrip substrate, the tapered microstrip tapering from a relatively narrow end to a relatively wide end, the relative wide end terminating where the microstrip substrate abuts against the surface wave substrate; and providing an adapter for coupling the coaxial transmission line to the relatively narrow end of the tapered microstrip.

BRIEF DESCRIPTION OF THE DRAWINGS

FIG. 1*a* depicts an embodiment of a CSWF; the CSWF 10 includes a microstrip whose width tapers from a relatively narrow end at a coax-to-MS adaptor (not shown in FIG. 1*a*) to relatively wider end at a surface-wave medium (SWM—not shown in FIG. 1*a*). The CSWF launches a surface wave with a broad phase front into the surface-wave medium and at least a portion of which may be an AIS antenna (also not shown in FIG. 1*a*).

FIG. 1*b* depicts a prior art device for launching surface waves which utilizes a low-profile waveguide coupler (LPWG) which protrudes from the antenna surface.

FIG. 2*a* is a plan view very similar to FIG. 1*a*, but depicted in a larger scale and with indicia identifying certain elements and features thereof, and with the SWM and AIS depicted.

DETAILED DESCRIPTION

Figure 1A:
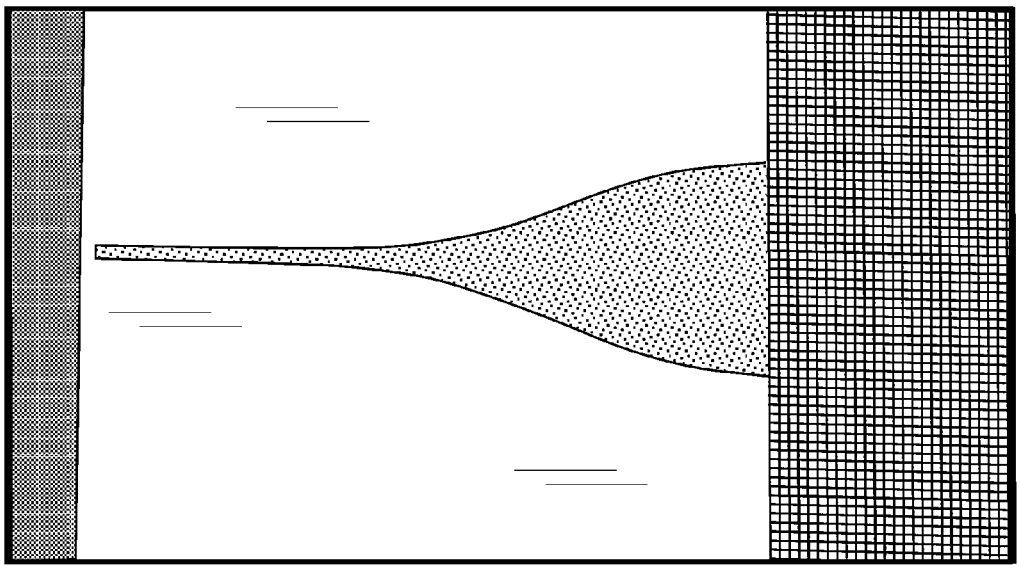
FIGS. 1*a*, 1*b*, and 2*a* as originally filed included photographs, which were amended to line drawings at the request of the USPTO. It is believed, however, that the original photographs may be helpful to the reader since photographs, by their very nature, tend to show more details of the disclosed embodiments than do line drawings. The originally filed photograph can be viewed in the file wrapper of this patent on-line at the USPTO website.
Figure 1B:
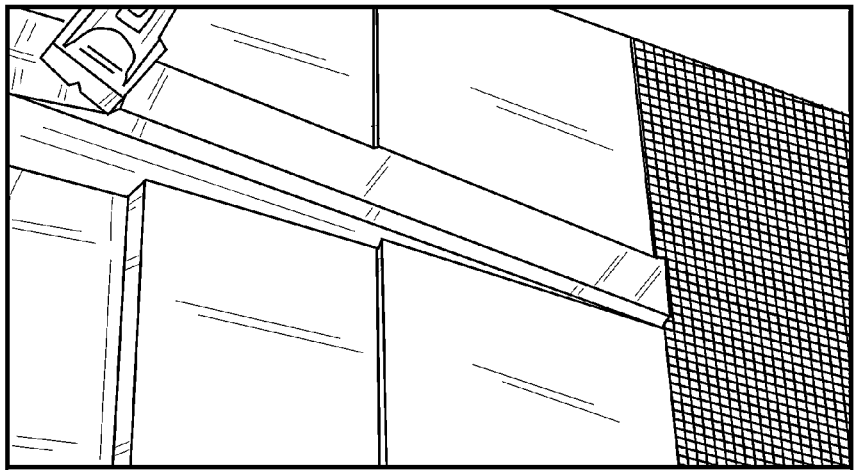

FIG. 1*a* depicts an embodiment of a CSWF 10. This embodiment of CSWF 10 is integrated with a 24 GHz conformal AIS antenna 20 on a 25-mil substrate. The CSWF 10 is a microstrip whose width tapers from 0.6 mm wide at a coax-to-MS adaptor (not shown in FIG. 1*a*, see element 16 in FIG. 2*a*) to 30 mm wide at the surface-wave medium in this embodiment. The CSWF launches a surface wave with a broad phase front into a surface-wave medium (SWM) at least a portion of which may be an AIS antenna (See FIG. 2*a* for a representation of the AIS antenna 20).

The CSWF 10 includes a metallic microstrip 13 whose width tapers from a narrow end 11 at a transmission line 15 (typically a 50 ohm coaxial cable) to microstrip adaptor 16 (not shown in FIG. 1*a*, but commercially available as model 292-04A-5 from Southwest microwave) to a wide end 12 at the surface-wave medium 22. The CSWF 10 launches a surface wave with a broad phase front into the aforementioned AIS antenna. The AIS 20 antenna is represented by a block in FIG. 2*a*.

The CSWF 10 need not be coupled to an AIS antenna as the CSWF 10 can be used to interface with SWMs used in devices other than AIS antennas. An SWM is a "surface wave medium". It is anything that supports surface electromagnetic waves. It is a type of artificial impedance surface (AIS). Not all AIS are SWMs as not all AIS support surface waves—on the contrary, some AIS are designed to inhibit surface waves. However, since an AISA (an AIS antenna) works by purposefully leaking surface waves from it, it is an SWM by definition.

The CSWF 10 has a microstrip taper formed by a metallic layer 13 on a thin dielectric substrate 14 (typically having a thickness in the range of 25-50 mils) with relatively low relative permittivity En (preferably in a range of 2-4). The relative permittivity of layer 14 is low compared to the AIS substrate's 22 relative permittivity $\in_{r2}$ which is typically around ~10. The thickness of the substrates scale inversely to the frequency of operation. For example, 50 mil substrates 14, 22 are preferred for 8 to 14 GHz AIS, 25 mil substrates 14, 22 for 18 to 30 GHz AIS, and 1" thick substrates 14,22 for 100 to 500 MHz AIS.

The narrow end 11 of the taper preferably interfaces to a standard transmission line connector 30 such as the aforementioned microstrip to coaxial connector. The width of the microstrip at the narrow end is chosen to match its impedance to the 50 ohm adaptor 16 according to well known technology. The wider end 12 of the taper interfaces to a surface-wave medium formed by metallic patches 26 on substrate 22 that supports the desired surface wave.

The taper in the tapered microstrip 13 minimizes insertion loss. Insertion losses of less than −25 dB have been experienced when following the design guidance suggested herein. A surface-wave impedance matching region 24 may be used if needed, which is formed by an array of metallic patches 26 on a dielectric substrate 22 whose permittivity is higher than the substrate 14 under the microstrip taper 13.

Although the CSWF 10 may be used in a number of applications, one currently preferred application is its use as a feed for an AIS antenna 20. See the application identified above for more information about AIS antennas. The AIS antenna 20 typically has metallic patches similar to the metallic patches 26 and may be formed on a substrate integral with substrate 22. The metallic patches of the AIS antenna 20 would typically start out with a uniform size corresponding to the smaller size patches 26 at the end of the surface wave impedance taper region 24 remote from the microstrip taper 13. Thereafter the sizes of patches in the AIS antenna 20 would be varied as discussed in the US patent application incorporated by reference to form transmission regions where the RF signal being applied via coaxial cable 15 (for example) is launched from the surface waves in the AIS antenna 20.

The size of the metal patches 26 varies along the direction of wave propagation denoted by arrow A with the patch size decreasing in size towards the AIS antenna 20.

Figures 2A, 2B:
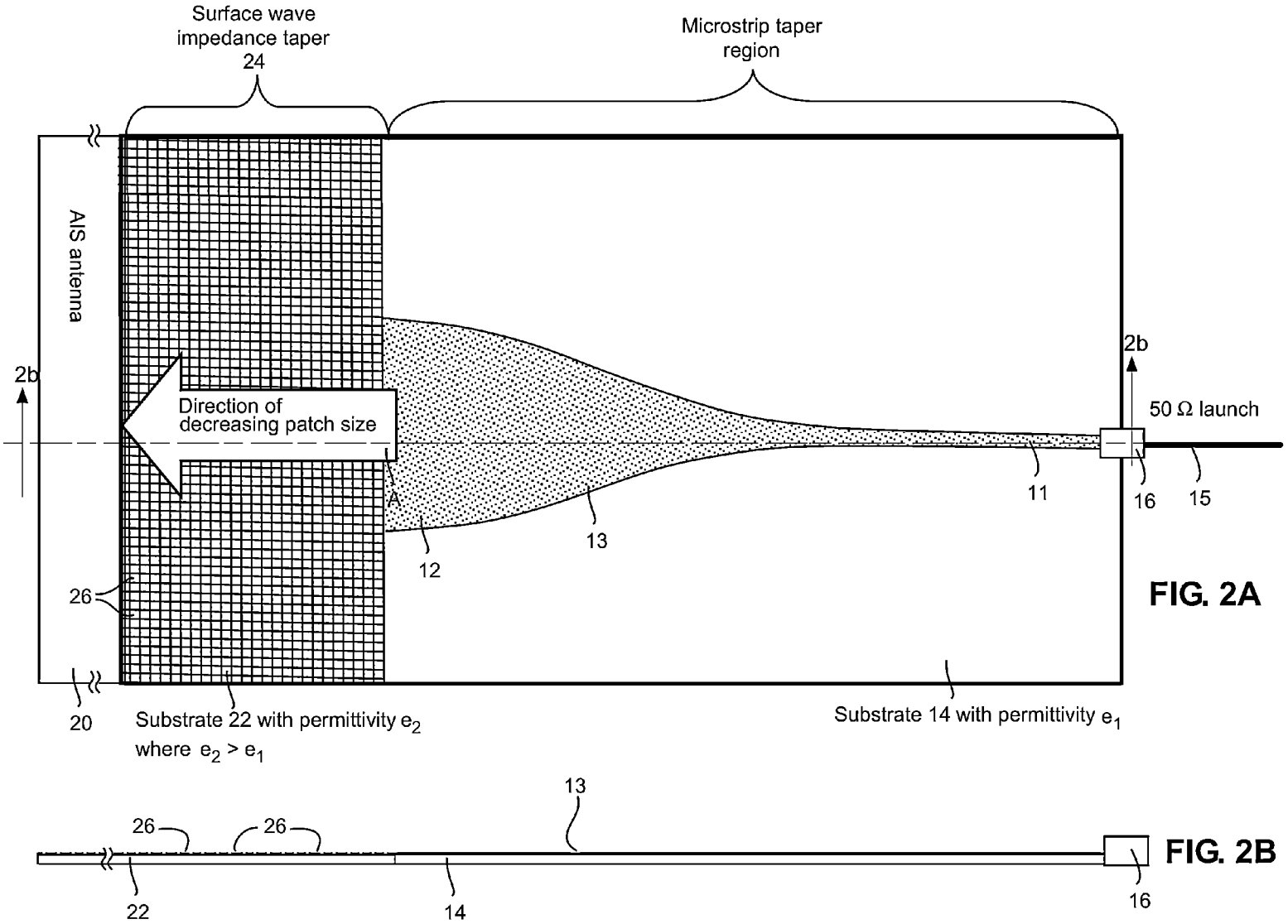
FIG. 2*b* is a section view taken through the CSWF of FIG. 2*a*.

An embodiment of disclosed CSWF 10 can be utilized, for example, to use surface waves to transmit high-rate data (>30 Mbps) or power (>1 W) in a two-dimensional surface-wave AIS antenna 20. FIGS. 1*a*, 2*a* and 2*b* show an exemplary embodiment of the CSWF 10 preferably used with a conformal AIS antenna 20 operating, in this embodiment, at 24 GHz. The dimensions of the tapered microstrip 13 in this embodiment are 100 mm long by 30 mm maximum width at end 12 and tapering to a 0.6 mm minimum width at end 11. The substrate 14, in this embodiment, is preferably 25-mil thick Rogers 3003 ($\in_{r1}$=3.0). The SWM of the surface wave impedance taper region 24 has 0.8 mm metallic square patches 26 distributed on a grid with a 1 mm period on substrate 22 which is preferably 25-mil thick Rogers 3010 substrate ($\in_{r2}$=10.2) in this embodiment. The impedance taper in region 24 can be realized by decreasing size of patches 26, or patch period or both. Rules of thumb: 1) impedance increases with patch size for a given patch period; 2) impedance increases with patch period for a given fractional patch size (patch size/period); 3) impedance increases with substrate permittivity, and 4) impedance increases with substrate thickness. Any or all of these rules of thumb can be used to implement the impedance taper in region 24.

The disclosed feed will work without the impedance taper 24 (by abutting the tapered microstrip directly to an AIS antenna 20, for example). But the impedance taper 24 is highly desirable to meet specifications for most applications, especially high power applications, since the return loss tends to be unacceptably high without it. The same material as substrate 22 is also preferably used as the substrate of the AIS antenna 20 and, indeed, substrate 22 is preferably shared by the AIS antenna 20 and the surface wave impedance taper 24 as an integral substrate 22.

Conformal artificial impedance surface antennas, which are described in the US patent application which is incorporated by reference, modulate a surface wave and radiate its power into a designed radiation pattern.

In any surface-wave research work, the surface waves must be interfaced to external instruments that rely on conventional RF transmission line communication methods, such as coaxial cables and related connectors. Artificial Impedance Surface antennas 20, whether or not they are conformal, need to be connected to transmitters and/or receivers and thus cables 15 are typically connected to such transmitters and/or receivers and those cables 15 need in turn to be connected to the AIS antenna 20. The disclosed CSWF 10 facilitates that connection.

An important element of the CSWF 10 is its tapered microstrip 13, one end 11 of which interfaces to a conventional transmission line impedance (for example a 50Ω coaxial cable 15), the other end 12 interfaces to a surface-wave medium which typically is in a surface wave impedance taper 24. A very desirable element is the surface-wave impedance taper 24, which matches the wave impedance at the end of the microstrip taper 13 to the surface-wave impedance in the surface-wave medium (SWM) being fed by the CSFW 10, which may be an AIS antenna 20 as described above. Of course, the SWM may comprise something other than an AIS antenna 20 since this invention is useful in launching surface waves from RF signals available in a conventional feed line, such as coaxial cable 15, into a SWM which can be used in a number of possible applications other than a AIS antenna 20.

The tapered microstrip 13 is designed to feed the surface wave in the SWM over a broad area, and the surface wave end 12 of the tapered microstrip 13 is therefore much wider than the coaxial end feed end 11. As the width of the tapered microstrip increases along the taper, the wave impedance changes as a function of its width according to well-known formulas governing microstrip design. The width is varied in such a way that the insertion loss between the wide and narrow ends is minimized. In practice, the impedance along the taper preferably matches what is known as a "Klopfenstein" impedance taper. See Klopfenstein, R. W., "A Transmission Line of Improved Design", *Proceedings of the IRE*, pp. 31-35, January 1956. Other types of impedance tapers will work as well.

As such, the taper shape seen in FIG. 2*a* is characteristic of the low-insertion loss taper formed by using a Klopfenstein impedance taper for the taper of the tapered microstrip 13. The length of the tapered microstrip 13 affects the insertion loss; longer tapers lead to lower insertion loss. In practice, a length equal to approximately two wavelengths of the transmitted wave (the RF signal in coaxial cable 15) is sufficient.

Wave speeds should be matched between the surface wave and wave in the tapered microstrip 13 at the boundary between the impedance taper 24 and the tapered microstrip 13 in order to minimize insertion loss between the two regions. In order to match the wave speeds, the substrate 14 permittivity $\in_1$ for the tapered microstrip 13 is lower than the substrate 22 permittivity $\in_2$ in the surface-wave region. The wave speed in the tapered microstrip 13 is approximately $c/\in_1^{1/2}$ over a wide bandwidth, where c is the speed of light and $\in r_1$ is the relative permittivity of substrate 14. Substrate thickness and tapered microstrip 13 width affect the wave speed in a well-known, but involved way not presented here. (See: I. J. Bahl and D. K. Trivedi, "A Designer's Guide to Microstrip Line", Microwaves, May 1977, pp. 174-182.) So the wave speed formula given above is just a rough approximation. The surface-wave speed in the surface wave taper region 24 is determined by the wave's frequency, the substrate permittivity $\in_2$ and its thickness, and the size and shape of the metallic patches 26 on the substrate 22. In general, the surface-wave speed approaches a lower limit of $c/\in r_2^{1/2}$ as the frequency and/or the substrate thickness increase (see C. Simovskii et al, "High-impedance surfaces having stable resonance with respect to polarization and incidence angle", IEEE Trans. Antennas Prop., vol. 53, 908, 2005, and O. Luukkonen et al, "Simple and accurate analytical model of planar grids and high-impedance surfaces comprising metal strips or patches", IEEE Trans. Antennas Prop., vol. 56, 1624, 2008). As is turns out, the wave speed in the SWM does not get particularly close to the stated limit for patches 26 of a reasonable size, and therefore the permittivity $\in_2$ of substrate 22 in the surface wave impedance taper 24 region must be greater than the permittivity $\in_1$ of substrate 14 under tapered microstrip 13.

In some applications, for example certain AIS antennas, the wave speed of the microstrip-guided waves at the end of the tapered microstrip 13 is lower than desired for that application. In this case, the surface-wave speed is caused to increase as the wave moves away from the tapered microstrip 13 by varying the sizes of the metallic patches in the surface-wave impedance taper region 24. The shapes are varied in such a way that the surface-wave impedance is varied in a controlled fashion that minimizes insertion loss from one end of the surface-wave impedance taper region 24. In practice, this is readily accomplished with a Klopfenstein impedance taper in terms of varying the sizes of the patches 26 in surface-wave impedance taper region 24. An impedance taper, such as the Klopfenstein taper, is a mathematical entity. It describes the impedance as a function of distance along a transmission line that matches the impedances between two transmission lines with different impedances. (The SWM can be considered to be a transmission line for surface waves.) For the taper in the microstrip line 16, this is realized with a strip that gradually spreads out. For the surface-wave impedance taper in region 24, the taper is a one-dimensional change in surface-wave impedance with distance. So the patches only have to vary in size along the direction of the propagation as depicted by the arrow of region 24 in FIG. 2*a*.

In an AIS antenna 20, the mean surface-wave impedance is relatively low—it is optimum at about 250 to 300 ohms/sq. The impedance necessary to match wave speeds to an SWM at the end of the tapered microstrip 13 is much higher, approximately 500 to 800 ohms/sq. So, in this case, and pretty much for all AIS antennas 20, there has to be a transition region 24 between the AIS antenna's operational surface and the high impedance region where the microstrip 13 terminates and couples to the AIS antenna 20 if a good match is desired. In such a case, an impedance taper in region 24 is essential. In an application where the AIS antenna 20 is just a SWM (like applications with power transfer or data transmission via surface waves), it is admissible to use an AIS (or SWM to be more general) with a high impedance everywhere. Then an impedance taper is not necessary. However, even in these applications, it can be desirable to taper the impedance in region 24 because for example, a lower impedance SWM is easier to make because it uses less metal or is thinner or uses a cheaper dielectric substrate with lower permittivity. These considerations are important when the SWM is very large as for a large scale SWM network. See, for example, U.S. Pat. No. 7,307,589 to Daniel Gregoire et al. entitled "Large-Scale Adaptive Surface Sensor Arrays".

Figure 3A:
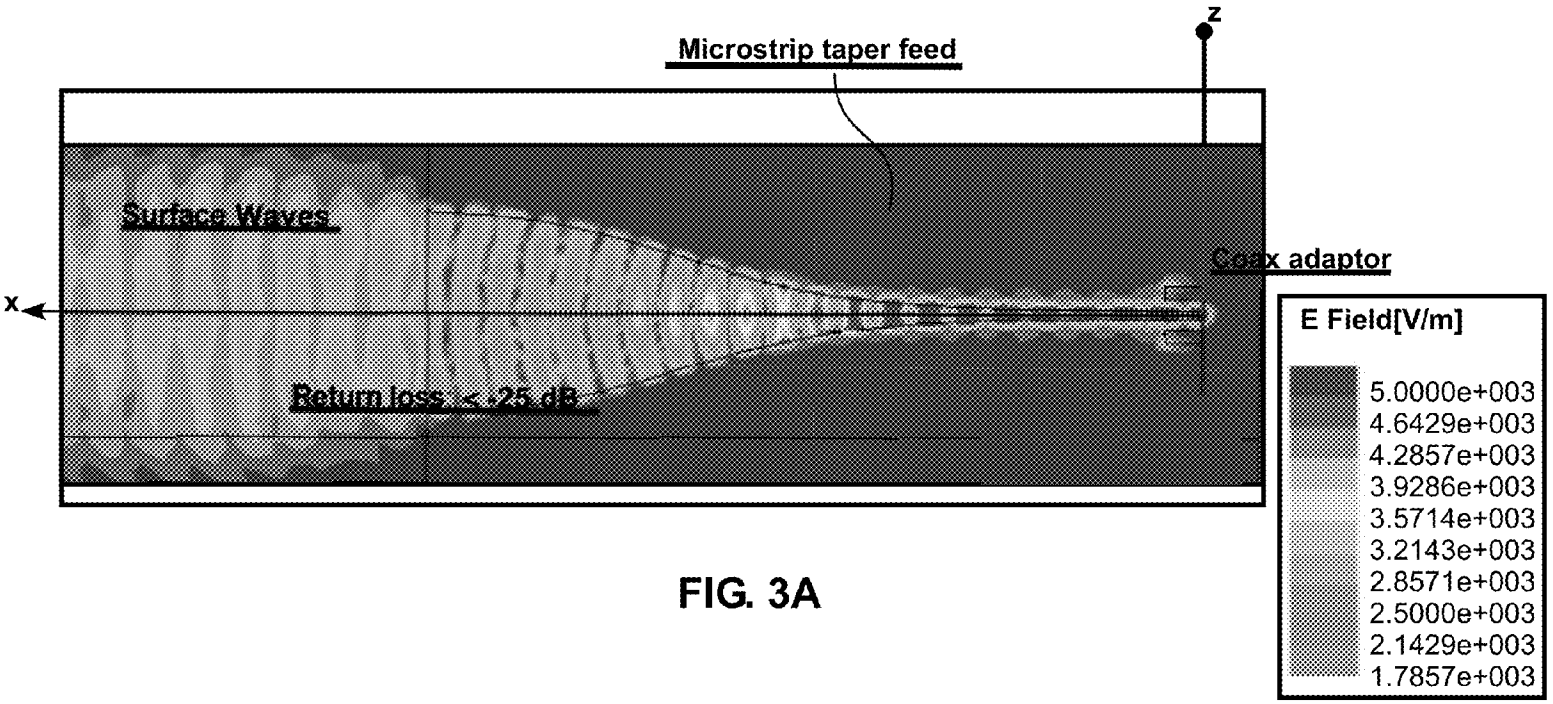
FIGS. 3*a* and 3*b* depict a simulation of the CSWF in plan (FIG. 3*a*) and side elevation (FIG. 3*b*) views. The MS taper is fed by the coaxial adaptor on the right. The wave propagates along the MS taper, spreading out into a broad phase front as the MS width increases. At the end of the MS taper, a surface wave is launched into the surface-wave medium (SWM) with insertion loss <−25 dB if the wave speeds are closely matched. In power transmission applications, the surface wave is incident on the CSWF from the left. The broad phase front of the surface wave is funneled through the MS taper to the narrow end of the MS taper where it is collected at a coaxial adaptor.
Figure 3B:
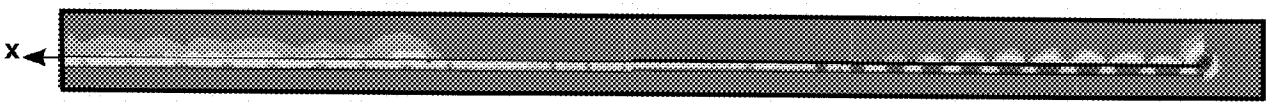

FIGS. 3*a* and 3*b* depict the results of a simulation done of the CSWF 10 of FIGS. 2*a* and 2*b*. The tapered microstrip 13 is fed via the coaxial adaptor 16 on the right. The wave propagates along the tapered microstrip 13, spreading out into a broad phase front as the tapered microstrip 13 width increases. At the end 12 of the taper of the tapered microstrip 13, a surface wave is launched into the surface-wave medium (SWM) region 24 with insertion loss <–25 dB if the wave speeds are closely matched.

In power transmission applications, the surface wave is incident on the CSWF 10 from the left. The broad phase front of the surface wave is funneled through the tapered microstrip 13 to the narrow end 11 of the tapered microstrip 13 where it is collected at the coaxial adaptor for downstream RF to DC conversion. Two possible power collection applications are (1) Broadcasting wireless power to a distributed network and (2) broadcasting wireless power from one place to another such as between a satellite and an earth station. With respect to the first possibility, a surface-wave power and communication network distributed across a 1 $m^2$ SWM (again, see U.S. Pat. No. 7,307,589), with a central hub broadcasting data and RF power across the SWM to multiple nodes which collect the RF power, convert it to DC, and use that power to run on-board CPU/radios that communicate with the central hub via surface waves. In the second possibility, the AISA 20 is used as a receiving antenna in wireless power transfer. In that case, microwave power is beamed from one place to another, e.g between a satellite and the earth station. The receiving antenna is an AISA which collects the microwaves on its surface and focuses it to a single point where it is collected by the CSWF 10 and then converted to DC downstream. The same system can work in reverse where the AISA 20 is the power transmitting antenna.

When used in the power collection applications, a broad surface-wave phase front is incident on the tapered microstrip 13, which then funnels the energy in the surface wave phase front down to the coaxial adaptor 16 where it can then be transmitted to an RF-to-DC converter to power devices such as CPUs, varactors, LEDs, etc. FIGS. 3*a* and 3*b* show the wave propagation from coaxial feed 15 to surface waves in a simulation of the CSWF 10. The insertion loss for the entire device is less than −25 dB when the wave speeds are matched between the tapered microstrip 13 region and the surface wave region. The overall insertion loss tends to be limited by the coax-to-microstrip adaptor 16. The grey level change of the fields in FIG. 3*a* indicates the changing power density along the length of the taper, with a maximum power density occurring at the adaptor 16.

In the tapered microstrip 13, the wave energy is confined to the metallic shape of the microstrip 13. If the RF energy originates from some device (such as a transmitter) coupled to the RF cable 15, the wave energy spreads out as the width of the tapered microstrip 13 increases along the length of the taper, where it then transitions into a surface wave with a broad phase front. If the RF energy originates as surface waves (such as from an AIS antenna 20), then the wave energy concentrates as the width of the tapered microstrip 13 decreases along the length of the taper towards the adapter 16, where it then transitions into a the RF cable 15.

Having described the invention in connection with certain embodiments thereof, modification will now suggest itself to those skilled in the art. As such, the invention is not to be limited to the disclosed embodiments except as is specifically required by the appended claims.

What is claimed is:

1. A transmission line feed for a surface wave medium having a dielectric substrate with an array of electrically conductive patches formed thereon, the transmission line feed comprising:

a. a microstrip substrate, the microstrip substrate having a first permittivity which is lower than a second permittivity of the dielectric substrate of the surface wave medium, the microstrip substrate abutting against the dielectric substrate of the surface wave medium;

b. a tapered microstrip disposed on the microstrip substrate, the tapered microstrip tapering from a relatively narrow end to a relatively wide end, the relative wide end terminating where the microstrip substrate abuts against the surface wave substrate; and c. an adapter for coupling a transmission line to the relatively narrow end of the tapered microstrip.

2. The transmission line feed of claim 1 wherein an upper surface of the surface wave substrate and an upper surface of the microstrip substrate are co-planar with each other.

3. The transmission line feed of claim 1 coupled to an AIS antenna, the AIS antenna comprising at least a portion of said surface wave medium.

4. The transmission line feed of claim 1 coupled to an AIS antenna, the AIS antenna having a substrate which abuts against the dielectric substrate of said surface wave medium.

5. The transmission line feed of claim 1 wherein the transmission line is a coaxial cable and the adapter is a coaxial cable to microstrip adapter.

6. The transmission line feed of claim 1 wherein the tapered microstrip follows a Klopfenstein taper.

7. The transmission line feed of claim 1 wherein the electrically conductive patches disposed on the surface wave medium decrease in size with increasing distance from the relatively wide end of the tapered microstrip.

8. The transmission line feed of claim 1 wherein the electrically conductive patches are metallic.

9. The transmission line feed of claim 8, wherein the metallic patches mimic a Klopfenstein impedance taper in a region immediately adjacent the relative wider end of the tapered microstrip.

10. The transmission line feed of claim 9, wherein at least a portion of the surface wave substrate with the array of electrically conductive patches formed thereon defines a surface-wave impedance matching region wherein the patches on the surface wave substrate in the surface-wave impedance matching region vary in size along a direction of surface wave propagation from and/or to said tapered microstrip.

11. The transmission line feed of claim 9 wherein the electrically conductive patches decrease in size along a direction moving away from said tapered microstrip.

12. A method of feeding RF energy to a surface wave medium having a dielectric substrate with an array of electrically conductive patches formed thereon, the RF energy being fed to said surface via a coaxial transmission line feed, said method comprising:

providing a microstrip substrate having a first permittivity which is lower than a second permittivity of the dielectric substrate of the surface wave medium;

butting the microstrip substrate against the dielectric substrate of the surface wave medium;

forming a tapered microstrip on the microstrip substrate, the tapered microstrip tapering from a relatively narrow end to a relatively wide end, the relative wide end terminating where the microstrip substrate abuts against the surface wave substrate; and coupling the coaxial transmission line to the relatively narrow end of the tapered microstrip.

13. A method of feeding RF energy to an AIS antenna having a dielectric substrate with an array of electrically conductive patches formed thereon, the RF energy being fed to said AIS antenna via a coaxial transmission line feed, said method comprising:

providing a microstrip substrate having a first permittivity which is lower than a second permittivity of the dielectric substrate of the AIS antenna;

butting the microstrip substrate against the dielectric substrate of the AIS antenna;

forming a tapered microstrip on the microstrip substrate, the tapered microstrip tapering from a relatively narrow end to a relatively wide end, the relative wide end terminating where the microstrip substrate abuts against the AIS antenna; and providing an adapter for coupling the coaxial transmission line to the relatively narrow end of the tapered microstrip.

14. The method of claim 13 wherein the AIS antenna has surface wave impedance taper region disposed on the dielectric substrate of the AIS antenna, the surface wave impedance taper region being disposed next to the relatively wide end of the tapered microstrip on the microstrip substrate.

15. The method of claim 13 wherein the patches in the surface-wave impedance matching region vary in size along a direction of surface wave propagation between said AIS antenna and the relatively wide end of said tapered microstrip.

16. A transmission line feed for a surface wave medium, the transmission line feed comprising:

a. a microstrip substrate abutting against the surface wave medium;

b. a tapered microstrip disposed on the microstrip substrate, the tapered microstrip tapering from a relatively narrow end to a relatively wide end, the relative wide end terminating where the microstrip substrate abuts against the surface wave medium; and c. means for coupling a transmission line to the relatively narrow end of the tapered microstrip.

17. The transmission line feed of claim 16 wherein an upper surface of the surface wave medium and an upper surface of the microstrip substrate are co-planar with each other.

18. The transmission line feed of claim 16 coupled to an AIS antenna, the AIS antenna comprising at least a portion of said surface wave medium.

19. The transmission line feed of claim 16 coupled to an AIS antenna, the AIS antenna having a substrate which abuts against the microstrip substrate of said surface wave medium.

20. The transmission line feed of claim 16 wherein the transmission line is a coaxial cable and the adapter is a coaxial cable to microstrip adapter.

21. The transmission line feed of claim 16 wherein the tapered microstrip follows a Klopfenstein taper.

22. The transmission line feed of claim 16 wherein the surface wave medium comprises a dielectric substrate with an array of electrically conductive patches formed thereon.

23. The transmission line feed of claim 22 wherein the electrically conductive patches disposed on the surface wave medium decrease in size with increasing distance from the relatively wide end of the tapered microstrip.

24. The transmission line feed of claim 23 wherein the electrically conductive patches are metallic.

25. The transmission line feed of claim 24, wherein the metallic patches mimic a Klopfenstein impedance taper in a region immediately adjacent the relative wider end of the tapered microstrip.

26. The transmission line feed of claim 24, wherein at least a portion of the surface wave substrate with the array of electrically conductive patches formed thereon defines a surface-wave impedance matching region wherein the patches on the surface wave substrate in the surface-wave impedance matching region vary in size along a direction of surface wave propagation from and/or to said tapered microstrip.

27. The transmission line feed of claim 24, wherein the microstrip substrate has a first permittivity which is lower than a second permittivity of a dielectric substrate of the surface wave medium.

28. A method of feeding RF energy to a surface wave medium, the RF energy being fed to said surface via a coaxial transmission line feed, said method comprising:

providing a microstrip substrate;

butting the microstrip substrate against the dielectric substrate of the surface wave medium;

forming a tapered microstrip on the microstrip substrate, the tapered microstrip tapering from a relatively narrow end to a relatively wide end, the relative wide end terminating where the microstrip substrate abuts against the surface wave substrate; and coupling the coaxial transmission line to the relatively narrow end of the tapered microstrip.

29. A method of feeding RF energy to an AIS antenna having a dielectric substrate with an array of electrically conductive patches formed thereon, the RF energy being fed to said AIS antenna via a coaxial transmission line feed, said method comprising:

providing a microstrip substrate;

butting the microstrip substrate against the dielectric substrate of the AIS antenna;

forming a tapered microstrip on the microstrip substrate, the tapered microstrip tapering from a relatively narrow end to a relatively wide end, the relative wide end terminating where the microstrip substrate abuts against the AIS antenna; and coupling the coaxial transmission line to the relatively narrow end of the tapered microstrip.

30. The method of claim 29 wherein the AIS antenna has surface wave impedance taper region disposed on the dielectric substrate of the AIS antenna, the surface wave impedance taper region being disposed next to the relatively wide end of the tapered microstrip on the microstrip substrate.

31. The method of claim 29 wherein the patches in the surface-wave impedance matching region vary in size along a direction of surface wave propagation between said AIS antenna and the relatively wide end of said tapered microstrip.

* * * * *